US005904340A

United States Patent [19]

Allamon

[11] Patent Number: 5,904,340

[45] Date of Patent: May 18, 1999

[54] HYDRAULIC DEVICE FOR AUTOMOBILE ACCIDENTS

[76] Inventor: Bruce D. Allamon, 10500 FM 1660 P.O. Box 634, Hutto, Tex. 78634

[21] Appl. No.: 09/026,143

[22] Filed: Feb. 19, 1998

[51] Int. Cl.[6] ..... B66F 3/24

[52] U.S. Cl. ..... 254/93 H; 254/133 R; 254/93 R; 72/705

[58] Field of Search ..... 254/93 H, 93 R, 254/133 R; 72/705; 269/133 R

[56] References Cited

U.S. PATENT DOCUMENTS

| | | | |
|---|---|---|---|
| 2,795,934 | 6/1957 | Jenkins | 254/93 R |
| 3,743,248 | 7/1973 | Moor | 254/93 R |
| 3,990,592 | 11/1976 | Migliano | 254/133 R |
| 4,781,045 | 11/1988 | Celette | 72/705 |
| 5,544,862 | 8/1996 | Hickerson | 72/705 |

*Primary Examiner*—Timothy V. Eley
*Assistant Examiner*—Daniel Shanley

[57] ABSTRACT

A new hydraulic device for automobile accidents for quickly freeing individuals trapped in a vehicle as a result of an accident. The inventive device includes a hydraulic member comprised of a plurality of telescoping cylinders. The cylinders include a base cylinder, a top cylinder, and a pair of intermediate cylinders therebetween. The base cylinder has a pair of diametrically opposed handles secured thereto. The base cylinder has a hydraulic line connector extending outwardly thereof for coupling with a hydraulic line. The base cylinder has a level indicator disposed thereon corresponding with the hydraulic line connector for measuring input of hydraulic power therein. The base cylinder has an externally threaded extension extending downwardly form a lower end thereof. The top cylinder has an externally threaded extension extending upwardly from an upper end thereof. A foot is provided that is comprised of a generally rectangular plate. The plate has an internally threaded cylindrical collar secured to an upper surface thereof. The cylindrical collar mates with the extension of the base cylinder. A lifting bracket is adapted for securement to the top cylinder. The lifting bracket has a cylindrical collar secured to a lower surface thereof for mating with the extension of the top cylinder. A locking collar engages the extension of the top cylinder over the cylindrical collar of the lifting bracket.

7 Claims, 3 Drawing Sheets

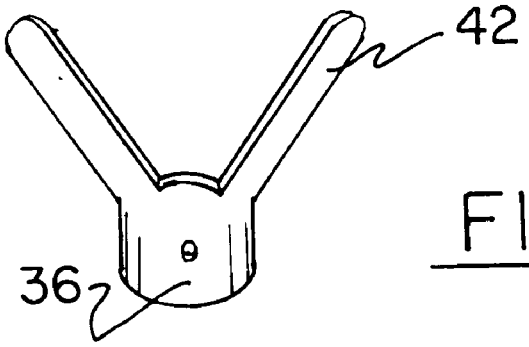
FIG.6
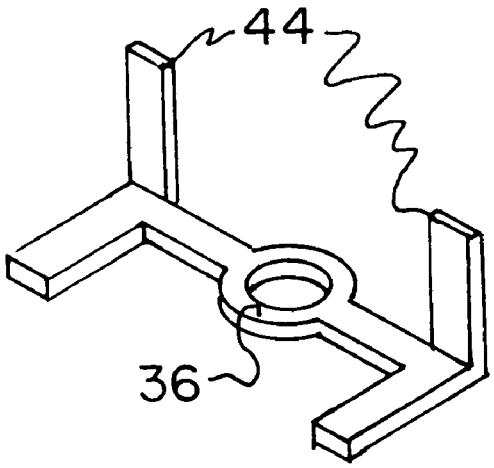
FIG.7
FIG.8
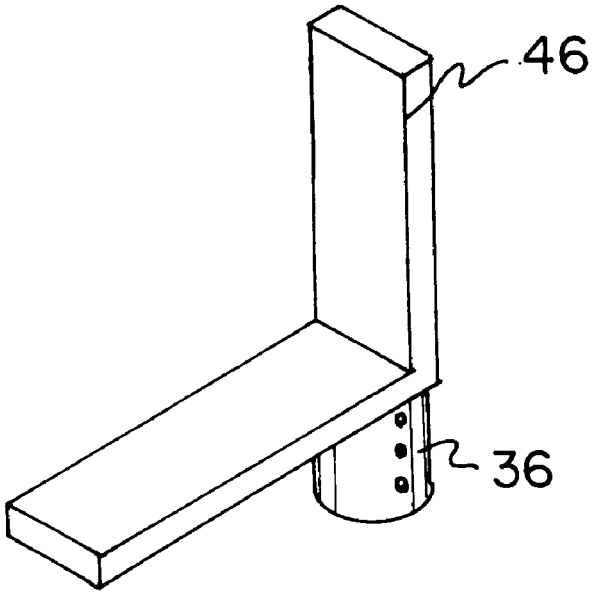

HYDRAULIC DEVICE FOR AUTOMOBILE ACCIDENTS

BACKGROUND OF THE INVENTION

1. Field of the Invention

The present invention relates to rescue devices and more particularly pertains to a new hydraulic device for automobile accidents for quickly freeing individuals trapped in a vehicle as a result of an accident.

2. Description of the Prior Art

The use of rescue devices is known in the prior art. More specifically, rescue devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art rescue devices include U.S. Pat. No. 5,267,462 to Pijanowski; U.S. Pat. No. 5,243,761 to Sullivan et al.; U.S. Pat. No. 4,706,937 to Chung; U.S. Pat. No. 4,598,898 to Hsu et al.; U.S. Pat. No. 4,481,864 to Peruzzi; and U.S. Pat. No. Des. 327,764 to Davis.

While these devices fulfill their respective, particular objectives and requirements, the aforementioned patents do not disclose a new hydraulic device for automobile accidents. The inventive device includes a hydraulic member comprised of a plurality of telescoping cylinders. The cylinders include a base cylinder, a top cylinder, and a pair of intermediate cylinders therebetween. The base cylinder has a pair of diametrically opposed handles secured thereto. The base cylinder has a hydraulic line connector extending outwardly thereof for coupling with a hydraulic line. The base cylinder has a level indicator disposed thereon corresponding with the hydraulic line connector for measuring input of hydraulic power therein. The base cylinder has an externally threaded extension extending downwardly form a lower end thereof. The top cylinder has an externally threaded extension extending upwardly from an upper end thereof. A foot is provided that is comprised of a generally rectangular plate. The plate has an internally threaded cylindrical collar secured to an upper surface thereof. The cylindrical collar mates with the extension of the base cylinder. A lifting bracket is adapted for securement to the top cylinder. The lifting bracket has a cylindrical collar secured to a lower surface thereof for mating with the extension of the top cylinder. A locking collar engages the extension of the top cylinder over the cylindrical collar of the lifting bracket.

In these respects, the hydraulic device for automobile accidents according to the present invention substantially departs from the conventional concepts and designs of the prior art, and in so doing provides an apparatus primarily developed for the purpose of quickly freeing individuals trapped in a vehicle as a result of an accident.

SUMMARY OF THE INVENTION

In view of the foregoing disadvantages inherent in the known types of rescue devices now present in the prior art, the present invention provides a new hydraulic device for automobile accidents construction wherein the same can be utilized for quickly freeing individuals trapped in a vehicle as a result of an accident.

The general purpose of the present invention, which will be described subsequently in greater detail, is to provide a new hydraulic device for automobile accidents apparatus and method which has many of the advantages of the rescue devices mentioned heretofore and many novel features that result in a new hydraulic device for automobile accidents which is not anticipated, rendered obvious, suggested, or even implied by any of the prior art rescue devices, either alone or in any combination thereof.

To attain this, the present invention generally comprises a hydraulic member comprised of a plurality of telescoping cylinders. The cylinders include a base cylinder, a top cylinder, and a pair of intermediate cylinders therebetween. The base cylinder has a pair of diametrically opposed handles secured thereto. The base cylinder has a hydraulic line connector extending outwardly thereof for coupling with a hydraulic line. The base cylinder has a level indicator disposed thereon corresponding with the hydraulic line connector for measuring input of hydraulic power therein. The base cylinder has an externally threaded extension extending downwardly form a lower end thereof. The top cylinder has an externally threaded extension extending upwardly from an upper end thereof. A foot is provided that is comprised of a generally rectangular plate. The plate has an internally threaded cylindrical collar secured to an upper surface thereof. The cylindrical collar mates with the extension of the base cylinder. A lifting bracket is adapted for securement to the top cylinder. The lifting bracket has a cylindrical collar secured to a lower surface thereof for mating with the extension of the top cylinder. A locking collar engages the extension of the top cylinder over the cylindrical collar of the lifting bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hydraulic device for automobile accidents apparatus and method which has many of the advantages of the rescue devices mentioned heretofore and many novel features that result in a new hydraulic device for automobile accidents which is not anticipated, rendered obvious, suggested, or even implied by any of the prior art rescue devices, either alone or in any combination thereof.

It is another object of the present invention to provide a new hydraulic device for automobile accidents which may be easily and efficiently manufactured and marketed.

It is a further object of the present invention to provide a new hydraulic device for automobile accidents which is of a durable and reliable construction.

An even further object of the present invention is to provide a new hydraulic device for automobile accidents which is susceptible of a low cost of manufacture with regard to both materials and labor, and which accordingly is then susceptible of low prices of sale to the consuming public, thereby making such hydraulic device for automobile accidents economically available to the buying public.

Still yet another object of the present invention is to provide a new hydraulic device for automobile accidents which provides in the apparatuses and methods of the prior art some of the advantages thereof, while simultaneously overcoming some of the disadvantages normally associated therewith.

Still another object of the present invention is to provide a new hydraulic device for automobile accidents for quickly freeing individuals trapped in a vehicle as a result of an accident.

Yet another object of the present invention is to provide a new hydraulic device for automobile accidents which includes a hydraulic member comprised of a plurality of telescoping cylinders. The cylinders include a base cylinder, a top cylinder, and a pair of intermediate cylinders therebetween. The base cylinder has a pair of diametrically opposed handles secured thereto. The base cylinder has a hydraulic line connector extending outwardly thereof for coupling with a hydraulic line. The base cylinder has a level indicator disposed thereon corresponding with the hydraulic line connector for measuring input of hydraulic power therein. The base cylinder has an externally threaded extension extending downwardly form a lower end thereof. The top cylinder has an externally threaded extension extending upwardly from an upper end thereof. A foot is provided that is comprised of a generally rectangular plate. The plate has an internally threaded cylindrical collar secured to an upper surface thereof. The cylindrical collar mates with the extension of the base cylinder. A lifting bracket is adapted for securement to the top cylinder. The lifting bracket has a cylindrical collar secured to a lower surface thereof for mating with the extension of the top cylinder. A locking collar engages the extension of the top cylinder over the cylindrical collar of the lifting bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a perspective view of the V-shaped lifting bracket of the present invention.

FIG. 7 is a perspective view of the double L-shaped lifting bracket of the present invention.

FIG. 8 is a perspective view of the L-shaped lifting bracket of the present invention.

DESCRIPTION OF THE PREFERRED EMBODIMENT

Figures 1, 2:
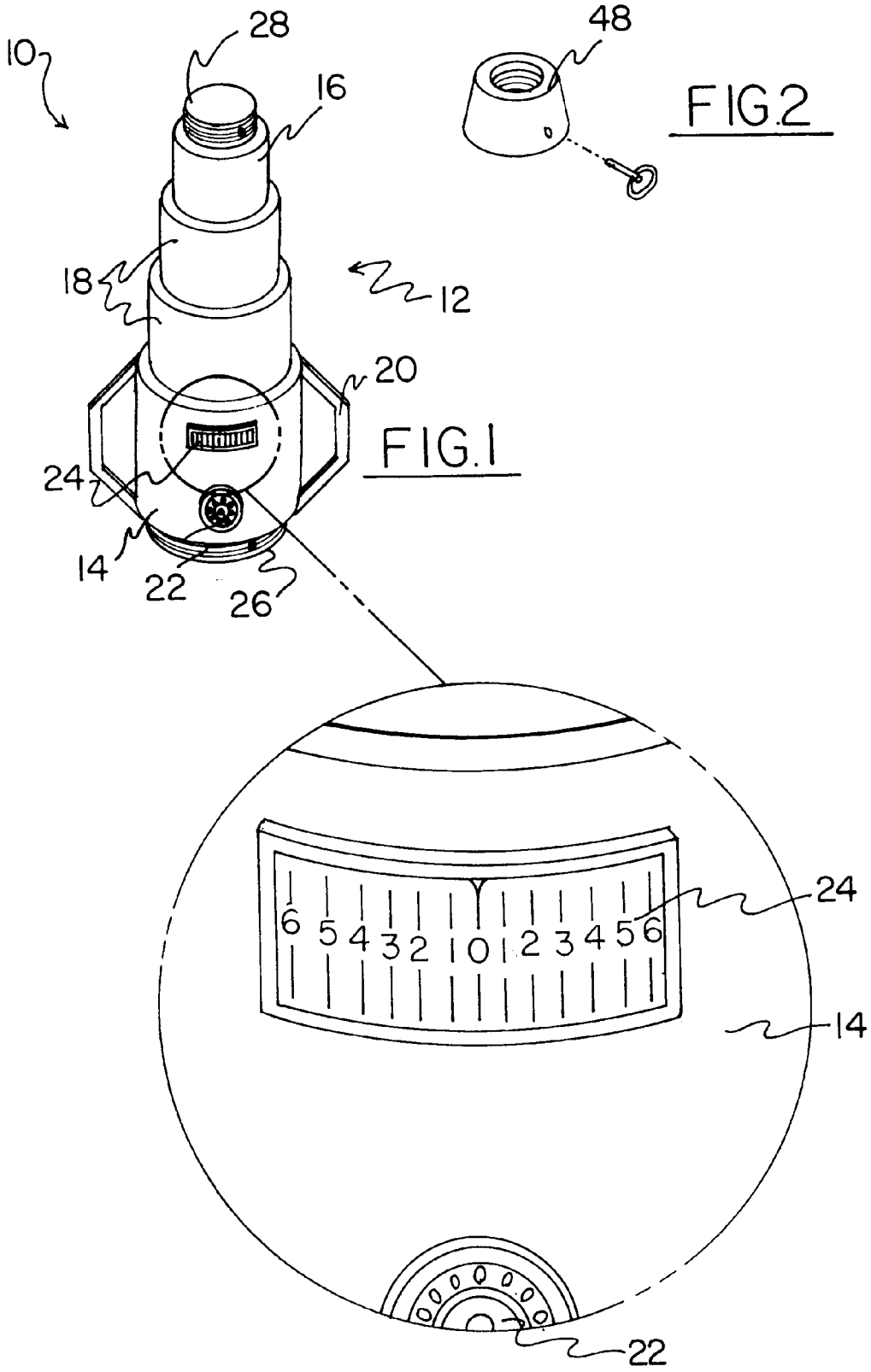
FIG. 1 is an isometric view of a new hydraulic device for automobile accidents according to the present invention.
FIG. 2 is an isometric view of the locking collar of the present invention.

With reference now to the drawings, and in particular to FIGS. 1 through 8 thereof, a new hydraulic device for automobile accidents embodying the principles and concepts of the present invention and generally designated by the reference numeral 10 will be described.

As best illustrated in FIGS. 1 through 8, the hydraulic device for automobile accidents 10 comprises a hydraulic member 12 comprised of a plurality of telescoping cylinders. The cylinders include a base cylinder 14, a top cylinder 16, and a pair of intermediate cylinders 18 therebetween. The base cylinder 14 has a pair of diametrically opposed handles 20 secured thereto. The base cylinder 14 has a hydraulic line connector 22 extending outwardly thereof for coupling with a hydraulic line. The base cylinder 14 has a level indicator 24 disposed thereon corresponding with the hydraulic line connector 22 for measuring input of hydraulic power therein. The base cylinder 14 has an externally threaded extension 26 extending downwardly form a lower end thereof. The top cylinder 16 has an externally threaded extension 28 extending upwardly from an upper end thereof. The hydraulic power will cause the cylinders to raise upwardly.

Figure 3:
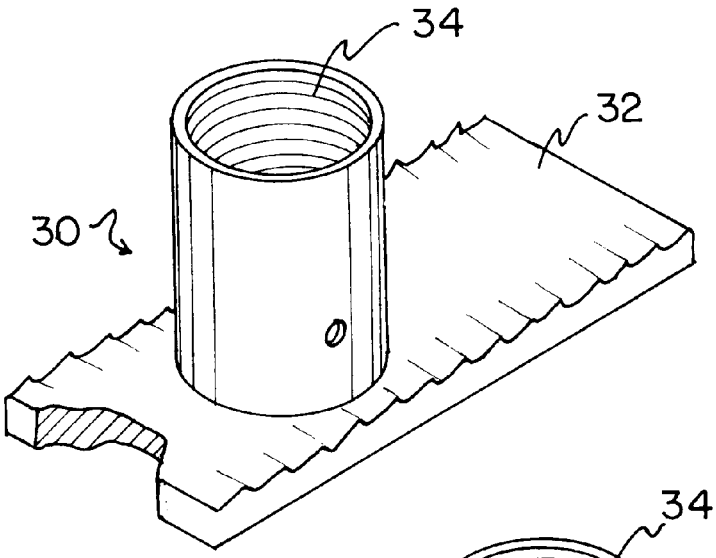
FIG. 3 is a perspective view of the metal foot of the present invention.
Figure 4:
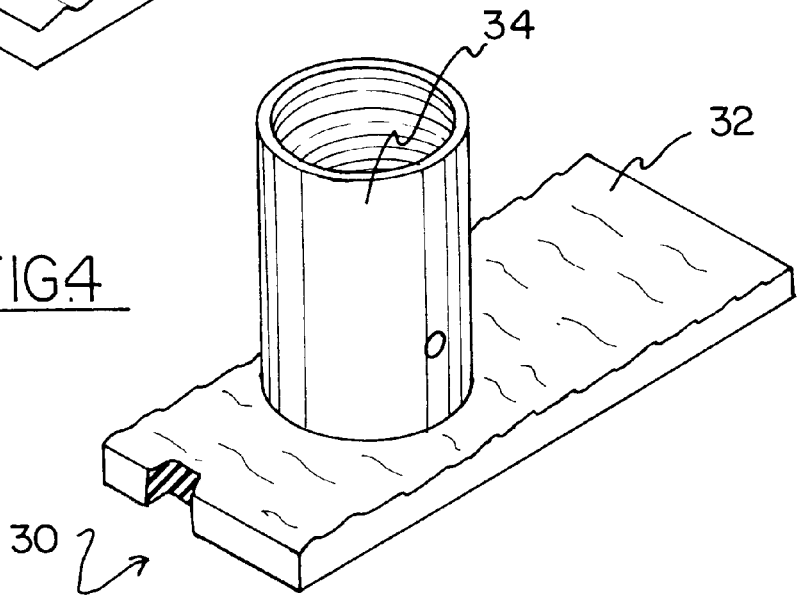
FIG. 4 is a perspective view of the rubber foot of the present invention.

A foot 30 is provided that is comprised of a generally rectangular plate 32. The plate 32 has an internally threaded cylindrical collar 34 secured to an upper surface thereof. The cylindrical collar 34 mates with the extension 26 of the base cylinder 12. The foot 30 could be either metal or rubber. A metal foot 30 is illustrated in FIG. 3. A rubber foot 30 is illustrated in FIG. 4.

Figure 5:
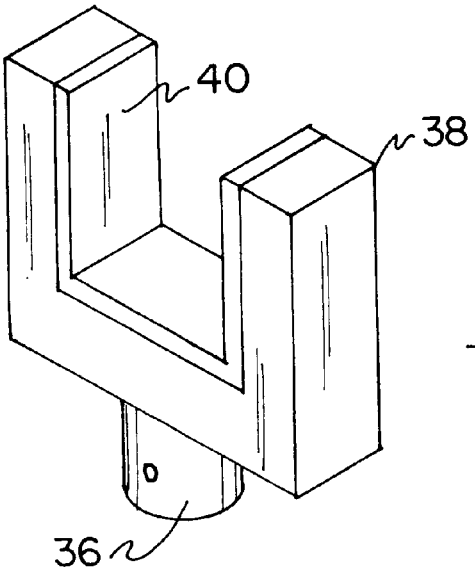
FIG. 5 is a perspective view of the U-shaped lifting bracket of the present invention.

A lifting bracket is adapted for securement to the top cylinder 16. The lifting bracket has a cylindrical collar 36 secured to a lower surface thereof for mating with the extension 28 of the top cylinder 16. The lifting bracket can be constructed in numerous shapes and configurations to suit the particular emergency. In FIG. 5, the lifting bracket has a generally U-shaped configuration 38. The lifting bracket has a metal outer surface and a rubber inner surface 40. In FIG. 6, the lifting bracket has a V-shaped configuration 42. In FIG. 7, the lifting bracket has pair of L-shaped supports 44 on opposing sides of the cylindrical collar 36. In FIG. 8, the lifting bracket has an L-shaped configuration 46.

A locking collar 48 engages the extension 28 of the top cylinder 16 over the cylindrical collar 36 of the lifting bracket.

In use, the present invention would be used by emergency medical personnel to quickly free individuals trapped in a vehicle as the result of an automobile accident. The device 10 could be used to lift the dashboard and steering wheel away from the driver of the vehicle. It could also be used to lift collapsed roofs of a vehicle, etc.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new hydraulic device for automobile accidents for quickly freeing individuals trapped in a vehicle as a result of an accident comprising, in combination:

a hydraulic member comprised of a plurality of telescoping cylinders, the cylinders including a base cylinder, a top cylinder, and a pair of intermediate cylinders therebetween, the base cylinder having a pair of diametrically opposed handles secured thereto, the base cylinder having a hydraulic line connector extending outwardly thereof for coupling with a hydraulic line, the base cylinder having a level indicator disposed thereon corresponding with the hydraulic line connector for measuring input of hydraulic power therein, the base cylinder having an externally threaded extension extending downwardly from a lower end thereof, the top cylinder having an externally threaded extension extending upwardly from an upper end thereof;

a foot comprised of a generally rectangular plate, the plate having an internally threaded cylindrical collar secured to an upper surface thereof, the cylindrical collar mating with the extension of the base cylinder;

a lifting bracket secured to the top cylinder, the lifting bracket having a cylindrical collar secured to a lower surface thereof for mating with the extension of the top cylinder; and a locking collar engaging the extension of the top cylinder over the cylindrical collar of the lifting bracket.

2. The hydraulic device for automobile accidents as set forth in claim 1 wherein the foot is metal.

3. The hydraulic device for automobile accidents as set forth in claim 1 wherein the foot is rubber.

4. The hydraulic device for automobile accidents as set forth in claim 1 wherein the lifting bracket has a generally U-shaped configuration, the lifting bracket has a metal outer surface and a rubber inner surface.

5. The hydraulic device for automobile accidents as set forth in claim 1 wherein the lifting bracket has a V-shaped configuration.

6. The hydraulic device for automobile accidents as set forth in claim 1 wherein the lifting bracket has a pair of L-shaped supports on opposing sides of the cylindrical collar.

7. The hydraulic device for automobile accidents as set forth in claim 1 wherein the lifting bracket has an L-shaped configuration.

* * * * *